US005595546A

United States Patent [19]

Masters

[11] Patent Number: 5,595,546

[45] Date of Patent: Jan. 21, 1997

[54] GOLF PUTTING AID

[76] Inventor: Albert D. Masters, P.O. Box 132, Washington, Okla. 73093

[21] Appl. No.: 514,912

[22] Filed: Aug. 14, 1995

[51] Int. Cl.[6] ..... A63B 69/36

[52] U.S. Cl. ..... 473/280; 473/422; 473/594; 473/601

[58] Field of Search ..... 273/187.3, 58 K; 473/280, 281

[56] References Cited

U.S. PATENT DOCUMENTS

| | | | |
|---|---|---|---|
| 784,367 | 3/1905 | Williams . | |
| 2,002,631 | 5/1935 | Fiondella . | |
| 3,114,550 | 12/1963 | Hughes . | |
| 3,184,234 | 5/1965 | Struble | 473/280 X |
| 3,357,705 | 12/1967 | Blanchard . | |
| 3,740,054 | 6/1973 | Arkin | 273/200 B X |
| 3,918,720 | 11/1975 | Gordos | 273/187.3 |
| 4,278,254 | 7/1981 | Simjian | 273/187.3 |
| 4,411,431 | 10/1983 | Judice | 273/187.3 |
| 4,783,078 | 11/1988 | Brown et al. . | |
| 4,921,255 | 5/1990 | Taylor . | |
| 4,925,193 | 5/1990 | Melvin . | |
| 5,020,803 | 6/1991 | Gendreau et al. . | |

*Primary Examiner*—George J. Marlo
*Attorney, Agent, or Firm*— Crutsinger & Booth

[57] ABSTRACT

A golf putting aid comprising first and second golf balls connected together in an abutting relationship by a threaded connector that extends into holes formed in the first and second golf balls. The first golf ball includes a center formed by a thin wall, an elastic cover wound around the thin wall, a hard cover enclosing the center and elastic cover, wherein the hole formed in the ball extends through the hard cover and terminates adjacent the center. The second golf ball also comprises a center formed by a thin wall, an elastic cover wound around the thin wall, a hard cover enclosing the center and elastic cover, wherein the hole formed in the ball extends through the hard cover and terminates adjacent the center. The threaded connector has first and second threaded ends extending into the holes and urges the first ball to abut the second ball, such that centers of the first and second golf balls are spaced apart a distance less than the length of the face of the putter.

5 Claims, 1 Drawing Sheet

GOLF PUTTING AID

TECHNICAL FIELD

A golf putting aid comprising a pair of golf balls connected to form a unitary apparatus in which surfaces of each ball can be struck by the face of a putter at precisely the same time so that each ball moves in the same direction at the same speed.

BACKGROUND OF INVENTION

The score of a person playing golf is the total of shots required to move the ball from the tee along the fairway, shots required to chip the ball onto the green and shots required to putt the ball into the cup. For an average golfer, shots required to putt the ball into the cup, after the green has been reached, accounts for more than one-half of the total strokes on each hole.

The primary emphasis of golf ball manufacturers is to provide a ball which travels the maximum distance along a predictable path when it is struck with a golf club. Golf balls are disclosed in U.S. Pat. No. 4,783,078; U.S. Pat. No. 4,921,255 and U.S. Pat. No. 5,020,803, the disclosures of which are incorporated herein by reference. The golf balls disclosed in these patents are generally referred to as a wound or three-piece golf ball comprising a cover molded about a core that has been built up from a center around which elastic thread has been wound.

One-piece golf balls are sometimes formed of a homogeneous mass of thermoset or thermoplastic material. Two-piece golf balls are generally formed from a solid homogeneous core around which a cover is molded.

The preference of individual golfers for one-piece, two-piece or wound golf balls varies from one golfer to another. However, all golfers strive to minimize the number of strokes required to put the ball in the hole.

Blanchard U.S. Pat. No. 3,357,705 discloses a golf practice projectile for use in practicing tee and fairway shots. The device is intended for use by golfers to practice and improve their abilities at the game of golf. However, such devices do not generally improve the golfer's putting skills.

A long felt need exists for a device to aid the golfer in perfecting putting skills. Golf club manufacturers provide putters having club heads of various designs and shafts of varying lengths. Lines are formed on some putters to aid the golfer in aligning the face of the putter, the ball and the hole in an effort to improve putting efficiency.

SUMMARY OF INVENTION

The golf putting aid disclosed herein is formed by joining two golf balls to provide a unitary device which travels in a straight line when both balls are struck simultaneously by a golf club. If the club head contacts one ball before it contacts the other ball, the device will tend to spin about an axis extending vertically. However, if both balls are struck at precisely the same time, both balls will rotate in the same direction about a horizontal axis at the same speed so that the unitary apparatus moves in a straight line.

In a preferred embodiment of the invention, opposite ends of a rod are secured in passages formed in two golf balls for supporting the golf balls such that adjacent surfaces are positioned in a juxtaposed relationship. This allows the balls to be struck simultaneously with the face of a putter.

DESCRIPTION OF DRAWINGS

Drawings of a preferred embodiment of the invention are annexed hereto so that the invention may be better and more fully understood, in which.

Numeral references are employed to designate like parts throughout the various figures of the drawing.

DESCRIPTION OF A PREFERRED EMBODIMENT

Figure 1:
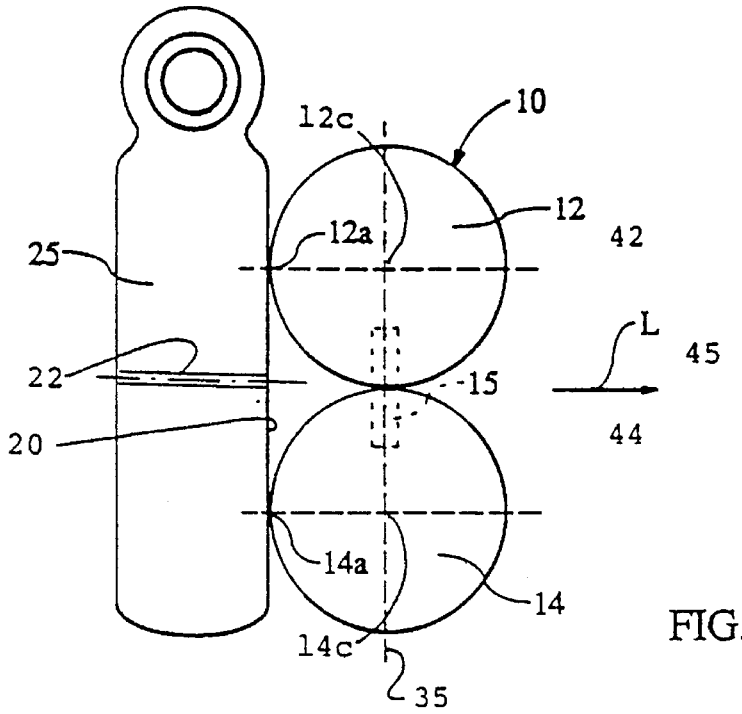
FIG. 1 is a top plan view of the golf putting aid diagrammatically illustrating the relationship between the golf putting aid and the head of a putter when the device is in use.

Referring to FIG. 1 of the drawing, the numeral 10 generally designates a golf putting aid comprising first and second golf balls 12 and 14 joined by a connector 15.

Figure 3:
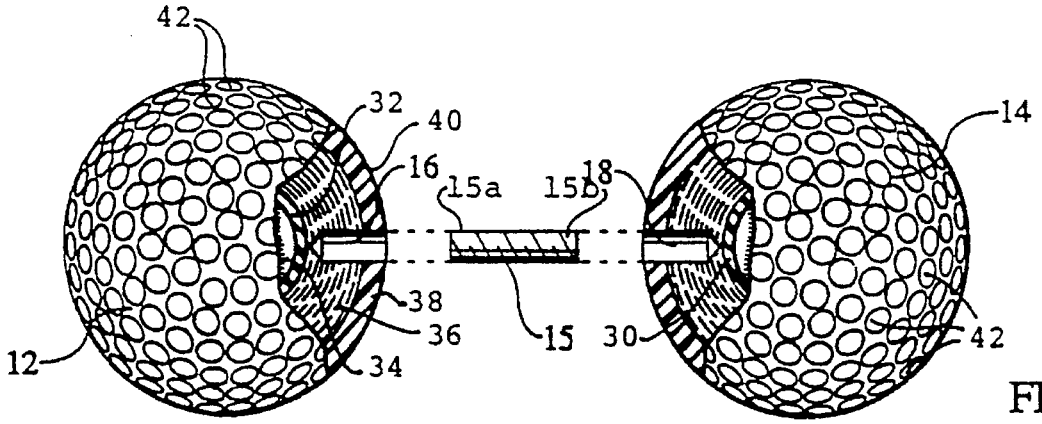
FIG. 3 is an exploded elevational view, parts being broken away to more clearly illustrate details of construction.

Referring to FIG. 3 of the drawing, each golf ball 12 and 14 is of substantially identical construction. Wound, or three-piece golf balls are shown in the illustrated embodiment. However, golf balls 12 and 14 may be one-piece balls made of a homogeneous mass of material or two-piece balls made from a solid, homogeneous core around which a cover is molded.

In the illustrated embodiment, each ball 12 and 14 has a center 30. Center 30 in the illustrated embodiment is formed by a thin walled envelope 32 filled with liquid 34. Liquid 34 is typically corn syrup, adjusted for specific gravity by the addition of an inert filler so that the size of center 30 is in a range from about 1" to 1⅛". Center 30 may be formed of a solid homogeneous mass of resilient material such as polybutadiene or natural rubber.

Elastic thread 36 is wound around center 30 and enclosed in a hard cover 38 having a dimpled outer surface 40. The hard cover 38 is typically formed of balata, gutta percha, Surlyn®, polyurethane or a combination of these materials. Balata covered three-piece golf balls generally have a higher spin rate than either Surlyn® covered three-piece balls or Surlyn® covered two-piece balls. One-piece balls, two-piece balls and wound balls formed of various combinations of materials generally have varying spin rates ranging from about 2200 rpm to about 3700 rpm.

As best illustrated in FIG. 3 of the drawing, passages 16 and 18 are formed in golf balls 12 and 14, respectively. In the illustrated embodiment, passages 16 and 18 are drilled through cover 38 and into the resilient elastic wound portion 36 of the ball. If balls 12 and 14 have liquid filled centers 30, it is important that passages 16 and 18 not pierce the envelope 32 of center 30.

In the illustrated embodiment, connector 15 is a rod having threads formed on the outer surface thereof. A first end **15*a* of rod 15 is screwed into passage 16 formed in ball 12 and a second end 15*b* of connector 30 is screwed into passage 18 formed in ball 14**.

While a threaded metal rod 15 is illustrated in the preferred embodiment, it should be readily apparent that connector 15 may be formed of other structures and that passages 16 and 18 may be formed by other processes. For example, passages 16 and 18 may be formed by melting or dissolving a portion of balls 12 and 14 and opposite ends **15*a* and 15*b* of connector 15 may be bonded or otherwise secured in passages 16 and 18. Further, if balls 12 and 14 are one-piece, two-piece or solid center wound balls, passages 16 and 18 may extend all the way through each ball 12 and 14 and connector 15 may have a length that is substantially equal to two times the diameter of a single golf ball. However, in the illustrated embodiment connector 15** has a length that is less than the diameter of a single golf ball.

Referring to FIG. 1 of the drawing, a generally horizontally disposed central axis 35 extends through the center of golf balls 12 and 14 and is aligned with the central axis of connector rod 15.

Figure 2:
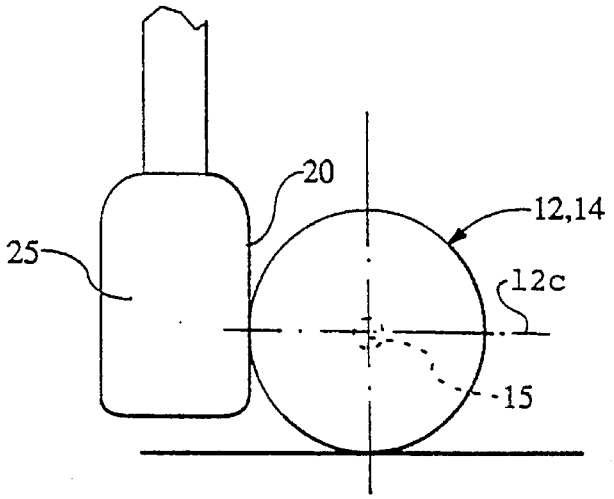
FIG. 2 is a side elevational view thereof.

A conventional putter, diagrammatically illustrated in FIGS. 1 and 2 of the drawing, has a face 20 on a club head 25. If the face 20 on club head 25 of the putter engages tangent points 12*a* and 14*a* on golf balls 12 and 14 at precisely the same time and at the same elevation, each golf ball 12 and 14 will move in the same direction at the same speed along spaced parallel lines of travel 42 and 44 and the unitary golf putting aid 10 will travel in a direction indicated by arrow 45, which is in alignment with a line of sight L.

However, if face 20 of putter head 25 engages golf ball 12 prior to the time that it engages golf ball 14, the initial movement of golf ball 12 will be along an arcuate path around the center 14*c* of golf ball 14 and the line of travel 45 of golf putting aid 10 will not be in alignment with the line of sight L along which the golfer intended for the golf putting aid to move.

The face 20 of a typical putter has a length in a range between about 2½" and about 4½", with a typical length being about 3¼". Surfaces 40 on golf balls 12 and 14 may be spaced apart; however, tangent points 12*a* and 14*a* are never spaced apart a distance greater than the length of the face 20 on heads 25 of the putter.

If the club head 25 has an alignment mark 22 passing through the "sweet spot" or center of gravity of club head 25, marker 22 preferably passes through the tangent points between golf balls 12 and 14 and is in alignment with the line of sight L so that the golfer "sees" the same alignment that he will use when striking a conventional golf ball. Thus the golfer positions golf putting aid 10 on the green and positions club head 25 such that marker 22 and line of sight L point toward the hole. The golfer then swings the club head 25 and attempts to contact balls 12 and 14 simultaneously to cause golf putting aid 10 to move such that the line of travel 42 and 44 of each ball is parallel to the line of sight L.

What is claimed is:

1. A golf putting aid comprising:

first and second golf balls having surfaces, each of said golf balls having a passage formed therein; and a connector having ends extending into said passages and urging said surfaces of said first and second golf balls into abutting relation forming tangent points between said first and second golf balls such that a line of sight from a golf club to a golf hole passes through the tangent points between said golf balls so that a golfer sees the same alignment that he will use when striking a conventional golf ball.

2. A golf putting aid according to claim 1, said connector comprising: a rod having first and second threaded ends secured in said passages in said first and second golf balls.

3. A golf putting aid according to claim 2, said first and second golf balls comprising:

wound, liquid center balls, said passages extending through said surfaces of said first and second golf balls and terminating adjacent said liquid centers.

4. A golf putting aid according to claim 1, said first and second golf balls comprising:

a resilient center;

resilient elastic thread wrapped around said resilient center;

a hard dimpled cover, said cover and said layer of resilient elastic thread having a passage formed therein; and said connector comprising a rigid rod having first and second threaded ends, said first threaded end being secured in said passage in said first golf ball and said second threaded end being secured in said passage in said second golf ball such that said first and second golf balls move as a unit.

5. A golf putting aid to be struck by the striking face of a conventional putter comprising:

first and second golf balls having centers; and a connector having first and second threaded ends connected to said first and second golf balls such that centers of said first and second golf balls are spaced apart a predetermined distance and said golf balls may be simultaneously engaged by the striking face of a conventional putter.

* * * * *